US008925159B2

(12) United States Patent
Chen

(10) Patent No.: US 8,925,159 B2
(45) Date of Patent: Jan. 6, 2015

(54) CORD CONNECTOR FOR WINDOW BLIND

(76) Inventor: Chin-Fu Chen, Taichung (TW)

( * ) Notice: Subject to any disclaimer, the term of this patent is extended or adjusted under 35 U.S.C. 154(b) by 227 days.

(21) Appl. No.: 13/411,881

(22) Filed: Mar. 5, 2012

(65) Prior Publication Data

US 2013/0227821 A1 Sep. 5, 2013

(51) Int. Cl.
*E06B 9/00* (2006.01)

(52) U.S. Cl.
USPC ..... 24/129 R; 24/128; 160/173 R

(58) Field of Classification Search
USPC ..... 24/129 R, 115 R, 122.3, 122.6, 128; 160/178.2, 168.1 R, 173 R, 178.1 R
See application file for complete search history.

(56) References Cited

U.S. PATENT DOCUMENTS 5,518,057 A * 5/1996 Huang ..... 160/178.1 R
2012/0266416 A1* 10/2012 Lee ..... 24/115 F
2012/0317754 A1* 12/2012 Chen ..... 24/115 R
2013/0007990 A1* 1/2013 Wen et al. ..... 24/115 R

* cited by examiner

*Primary Examiner* — Robert J Sandy
*Assistant Examiner* — Michael Lee
(74) *Attorney, Agent, or Firm* — Muncy, Geissler, Olds & Lowe, P.C.

(57) ABSTRACT

A cord connector for a window blind includes a cord hole having a large hole portion and two small hole portions each communicated with the large hole portion through a neck portion defined by two opposite engaging walls. The diameter of the large hole portion is larger than that of a cord used in the window blind, the small hole portions each have a diameter equal to the cord diameter, and the width of the opposite engaging walls is smaller than the cord diameter. When the cord connector is in use, the cords are respectively inserted into the small hole portions of the cord hole. If an external force exerting on the cords overcomes the resistances of the engaging walls, the cords will move from the small hole portions to the large hole portion and then escape from the cord connector.

8 Claims, 9 Drawing Sheets

CORD CONNECTOR FOR WINDOW BLIND

BACKGROUND OF THE INVENTION

1. Field of the Invention

The present invention relates generally to window blinds and more particularly, to a cord connector for a window blind.

2. Description of the Related Art

To facilitate control of opening or closing a window blind, the lift cords of the widow blind are usually designed to be accessibly exposed for operation by a user. In addition, a cord connector is generally used to connect the suspended ends of the lift cords for preventing the lift cords from being intertwined so as to achieve the purpose of collecting and arranging the lift cords.

Conventionally, the lift cords are fixed to the cord connector, such that one or more loops will be formed between the two or more cords and the connector. In other words, the lift cords fixed to a conventional cord connector will become a dangerous object to a toddler or young child who plays around the window blind because the toddler's or young child's neck may be hung on the loops or wrapped by the cords accidentally. Therefore, it is desired to have a safety cord connector for a window blind.

SUMMARY OF THE INVENTION

The present invention has been accomplished in view of the above-noted circumstances. It is therefore the primary objective of the present invention to provide a cord connector for connecting two or more cords of a window blind, which will be separated away from the cords by an exceeding force exerting thereon so as to enhance the safety of a user.

To achieve the above-mentioned objective, the cord connector for connecting two or more cords of a window blind provided by the present invention comprises a housing with a cord hole at a top thereof. The cord hole has a large hole portion and two small hole portions each communicated with the large hole portion through a neck portion defined by two opposite engaging walls, wherein the large hole portion has a diameter larger than a diameter of the cord for passage of the cord, and each of the small hole portions has a diameter substantially equal to the diameter of the cord for insertion of the cord, and the engaging walls have a width smaller than the diameter of the cord for engagement with the cord. By this way, when the cords are crossed with each other and an external force exceeds the engaging force between the engaging walls of the cord hole, the cords will move from the small hole portions of the cord hole to the large hole portion of the cord hole, such that the cords will be separated from the cord connector so as to attain the purpose of enhancing safety in use.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
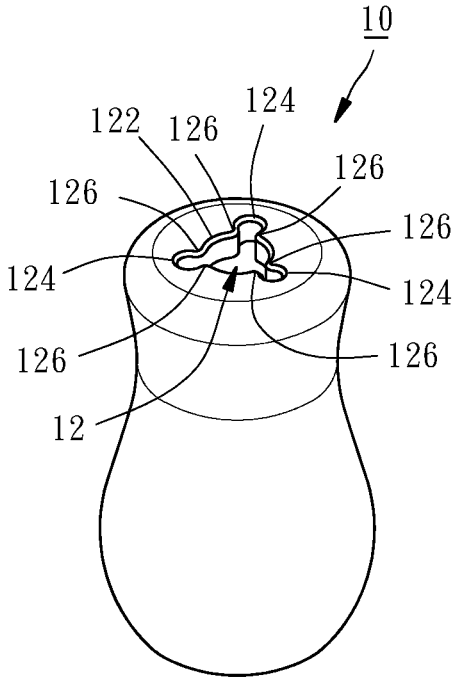
FIG. 1 is a perspective view of a cord connector in accordance with a first preferred embodiment of the present invention.
Figure 4:
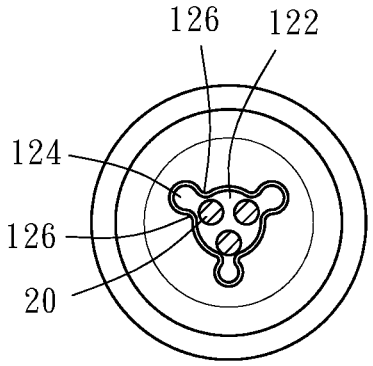
FIG. 4 is similar to FIG. 2, but showing that the cords are moved towards the large hole portion of the cord hole.

Referring to FIG. 1, a cord connector 10 provided by a first preferred embodiment of the present invention is adapted to be used in cooperation with three cords 20 of any kind of window blind. The cord connector 10 is integrally formed as a single housing, including a top with a cord hole 12. The cord hole 12 has a large hole portion 122 and three small hole portions 124 each communicated with the large hole portion 122 through a neck portion defined by two opposite engaging walls 126, as shown in FIGS. 2 and 4, wherein the large hole portion 122 has a diameter larger than a diameter of the cord 20 for passage of the cord 20, and the small hole portions 124 each have a diameter substantially equal to the diameter of the cord 20 for insertion of the cord 20, and the engaging walls 126 have a width smaller than the diameter of the cord 20 for engagement with the cord 20.

Figure 2:
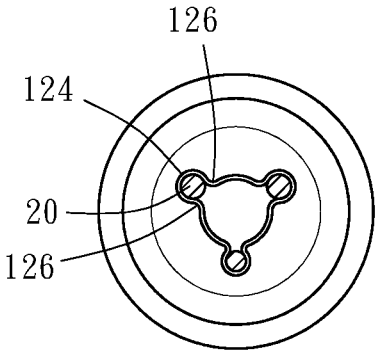
FIG. 2 is a top view of the cord connector of FIG. 1, with which cords are coupled.
Figure 3:
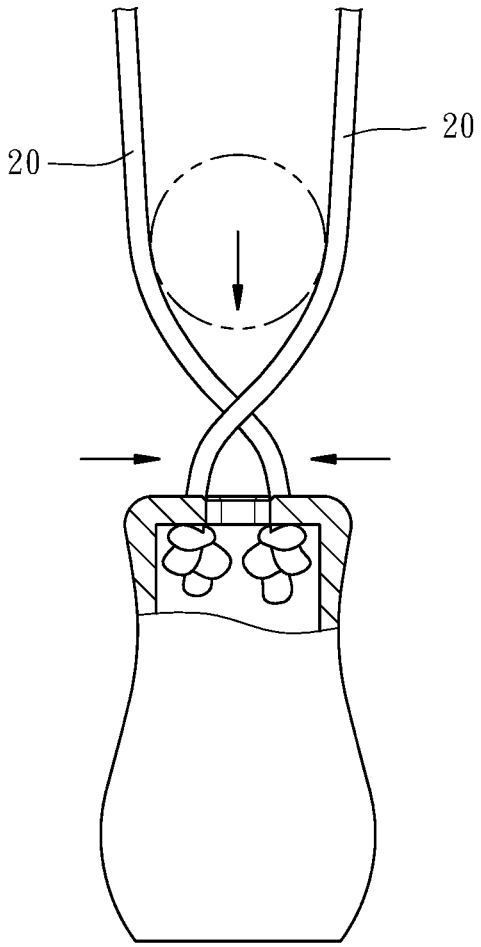
FIG. 3 is a cross-sectional view of the cord connector of FIG. 1, with which cords are coupled.
Figure 5:
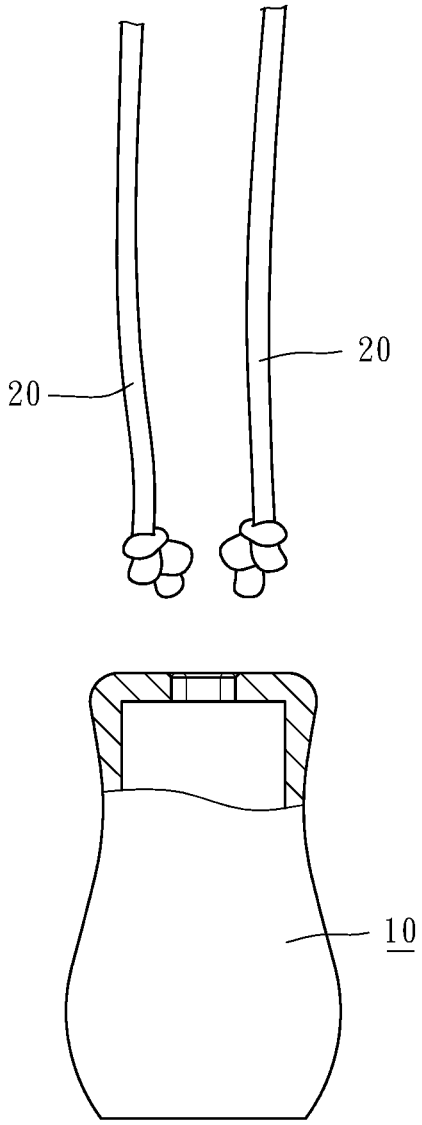
FIG. 5 is similar to FIG. 3, but showing that the cords and the cord connector are separated from each other.
Figure 6:
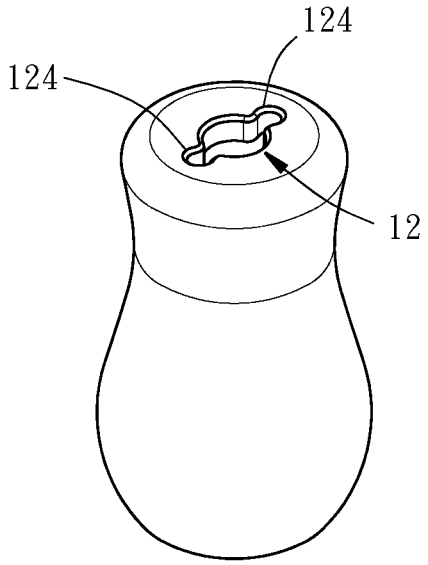
FIG. 6 is a perspective view of an alternate form of the cord connector according to the first preferred embodiment of the present invention, showing that the cord connector has two small hole portions.
Figure 7:
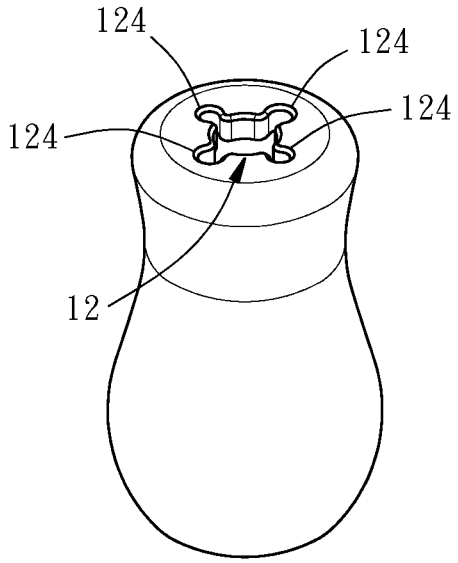
FIG. 7 is a perspective view of an alternate form of the cord connector according to the first preferred embodiment of the present invention, showing that the cord connector has four small hole portions.

When the cord connector 10 is used, the cords 20 is inserted into the small hole portions 124 of the cord hole 12 and jammed between the engaging walls 126, as shown in FIG. 2. When a foreign object, e.g. the neck of a child, enters the loop defined by three cords 20, which are crossed with each other as shown in FIG. 3, and the cord connector 10, and then moves downwardly to press on the cords 20, the cords 20 that receive the pressing force will move from the small hole portions 124 of the cord hole 12 towards the large hole portion 122 of the cord hole 12. If the pressing force exerting on the cords 20 exceeds the engaged force between the engaging walls 126 of the cord hole 12, the cords 20 will pass through the engaging walls 126 of the cord hole 12 and then escape from the cord connector 10 through the large hole portion 122 of the cord hole 12, as shown in FIGS. 4 and 5, preventing the child's neck from hanging on the cords 20 so as to enhance the safety in use.

Figure 8:
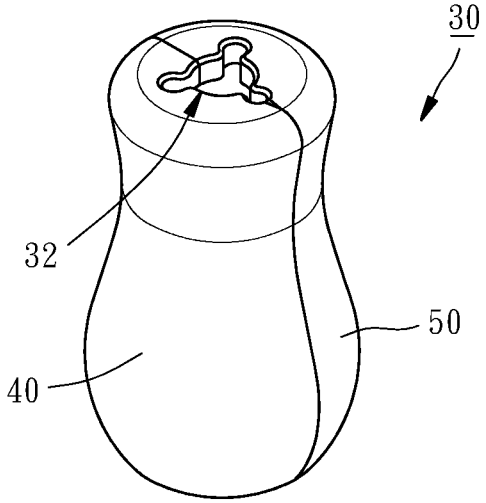
FIG. 8 is a perspective view of a cord connector in accordance with a second preferred embodiment of the present invention.

FIG. 8 shows a cord connector 30 in accordance with a second preferred embodiment of the present invention, which comprises a first half shell 40 and a second half shell 50. The cord hole 32 is defined between the tops of the first and second half shells 40 and 50.

Figure 9:
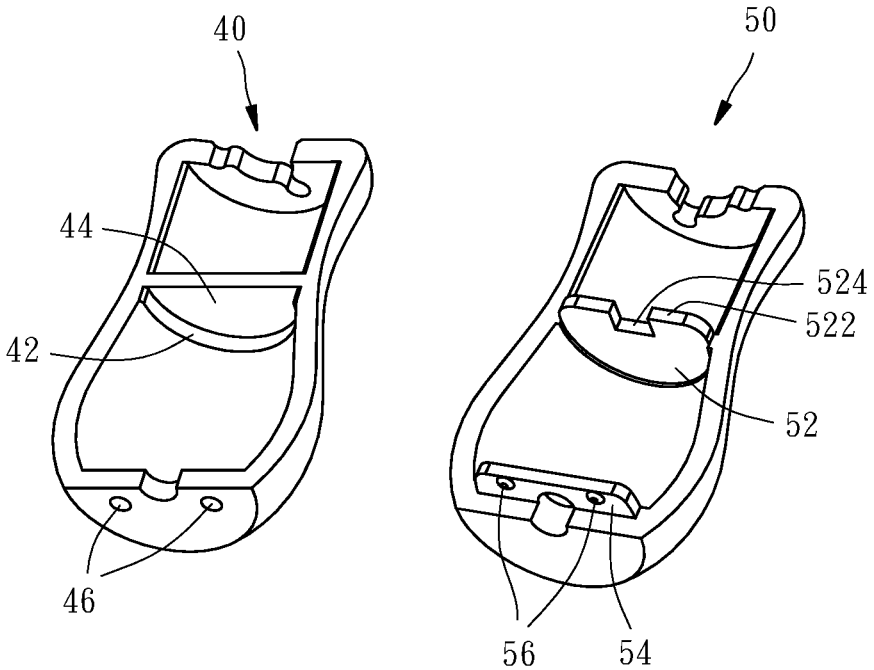
FIG. 9 is an exploded view of the connector shown in FIG. 8.

As shown in FIG. 9, the first half shell 40 has a positioning notch 42 arranged at an inner side thereof, a retaining wall 44 neighbored to the positioning notch 42, and a first coupling portion 46 at a bottom thereof. The first coupling portion 46 is embodied as two spaced concavities.

Figure 10:
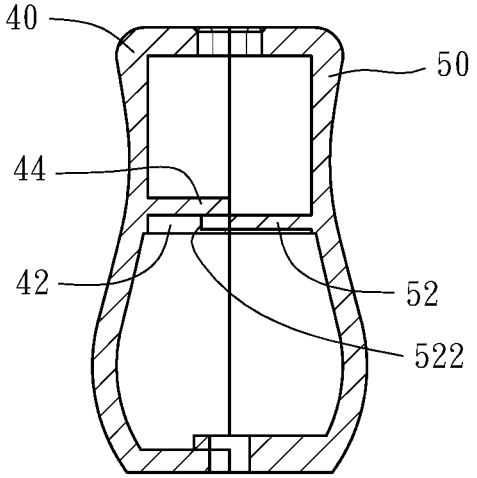
FIG. 10 is a cross-sectional view of the connector of FIG. 8.

As shown in FIGS. 9 and 10, the second half shell 50 includes a positioning wall 52 arranged at an inner side thereof and having an urging end 522, which is engaged in the positioning notch 42 of the first half shell 40 and urged against the retaining wall 44 of the first half shell 40. The urging end 522 is provided with a cut 524, such that the urging end 524 of the positioning wall 52 is flexibly deformable for enhancing the convenience in assembly. In addition, the second half shell 50 has a coupling wall 54 extending outwardly from the bottom thereof and abutted with the bottom of the first half shell 40 and provided with a second coupling portion 56. The second coupling portion 56 is embodied as two spaced convexities respectively engaged in the concavities of the first half shell 40.

Figure 11:
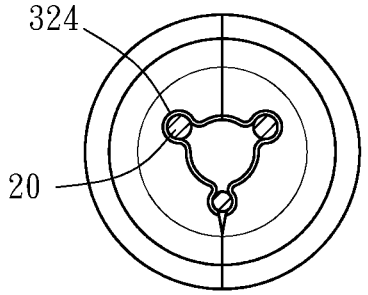
FIG. 11 is a top view of the cord connector of FIG. 8, with which the cords are coupled.
Figure 12:
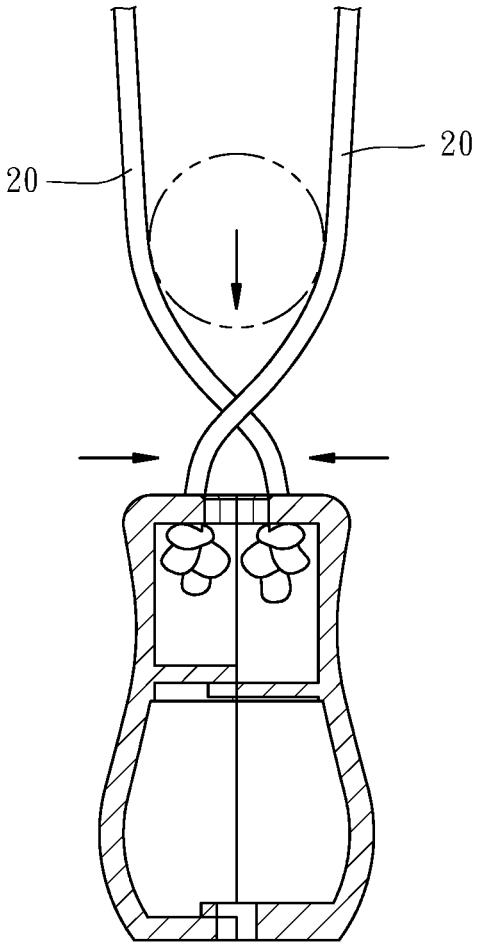
FIG. 12 is a cross-sectional view of the cord connector of FIG. 8, with which the cords are coupled in a crossed manner.
Figure 13:
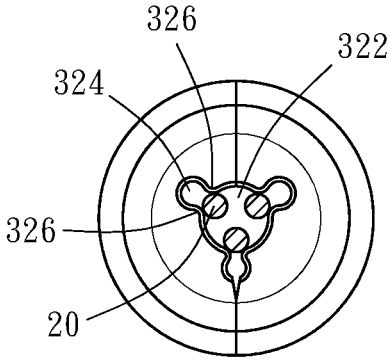
FIG. 13 is a top view of the cord connector of FIG. 8, showing the cords are moved towards the large hole portion of the cord hole.
Figure 14:
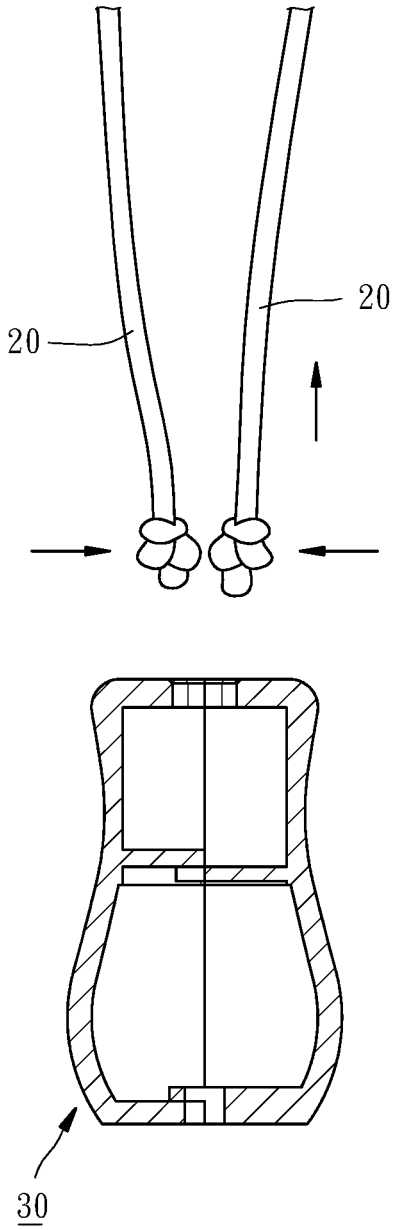
FIG. 14 is a cross-sectional view of the cord connector of FIG. 8, but showing that the cords and the cord connector are separated from each other.
Figure 15:
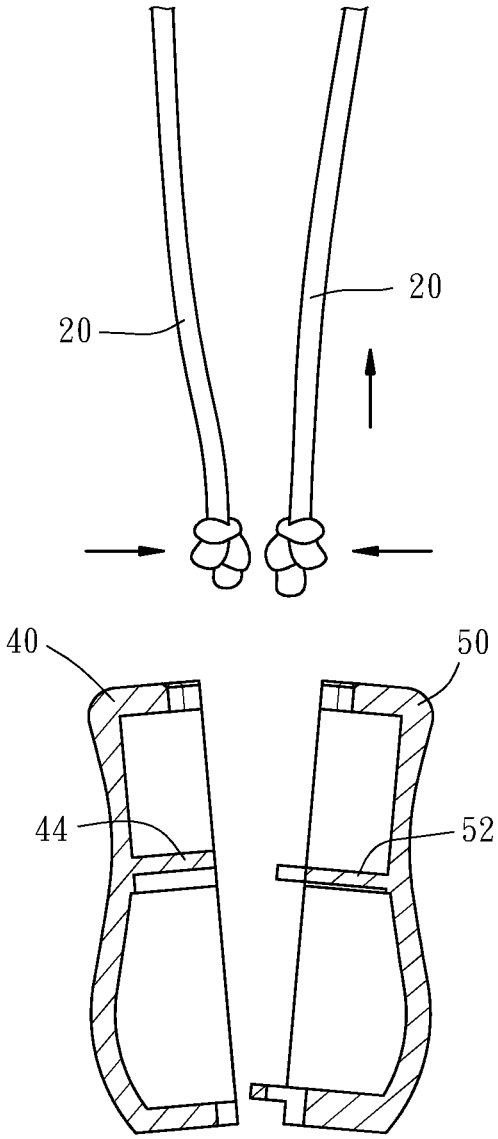
FIG. 15 is a cross-sectional view of the cord connector of FIG. 8, but showing that the first and second half shells are separated from each other.
Figure 16:
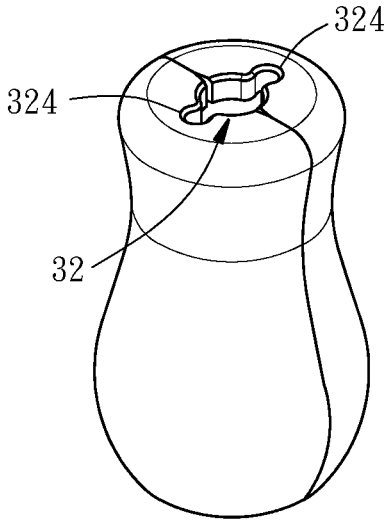
FIG. 16 is a perspective views of an alternate form of the cord connector according to the second preferred embodiment of the present invention, showing that the cord connector has two small hole portions.
Figure 17:
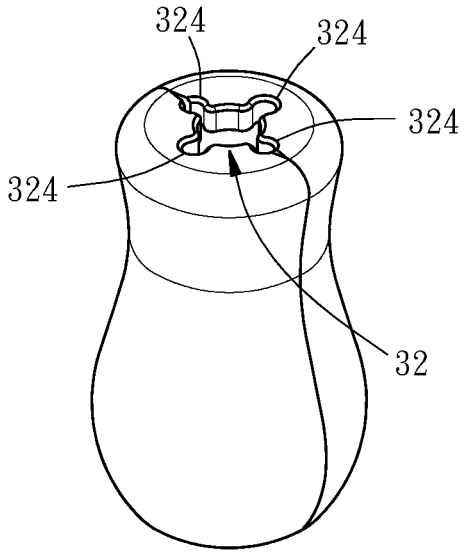
FIG. 17 is a perspective view of an alternate form of the cord connector according to the second preferred embodiment of the present invention, showing that the cord connector has four small hole portions.

When a foreign object, e.g. the neck of a child, enters the loop defined by three cords 20, which are crossed with each other as shown in FIG. 12, and the cord connector 30, and then moves downwardly to press on the cords 20, the cords 20 that receive the pressing force will move from the small hole portions 324 of the cord hole 32 towards the large hole portion 322 of the cord hole 32, as shown in FIGS. 11 and 13. At this time, the cords 20 may escape from the cord connector 30 through the large hole portion 322 of the cord hole 32, as shown in FIG. 14, if the pressing force exerting on the cords 20 exceeds the engaging force between the engaging walls 326 of the cord hole 32. On the other hand, if the cords 20 are respectively jammed in the large hole portion 322 of the cord hole 32, the retaining wall 44 of the first half shell 40 and the positioning wall 52 of the second half shell 50 may be forced to separate away from each other for allowing the separation of the first and second half shells 40 and 50. After the separation of the first and second half shells 40 and 50, the cords 20 can escape from the first and second half shells 40 and 50, as shown in FIG. 15. In either event, it can prevent the user's neck from being hung on the cords 20.

It is to be understood that the number of small hole portions of the cord hole of the cord connector are not limited to three. For example, as shown in FIGS. 6, 7, 16, and 17, the cord holes 12 and 32 can be respectively provided with two or four small hole portions 124 and 324 according to the number of the cords to be used. These connectors can achieve the same effect as the connectors 10 and 30 that are respectively shown in FIG. 1 and FIG. 8 do.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cord connector for a window blind having a cord, the cord connector comprising:

a housing having a top with a cord hole, the cord hole having a large hole portion and at least two small hole portions each communicated with the large hole portion through a neck portion defined by two opposite engaging walls, wherein the large hole portion has a diameter larger than a diameter of the cord, the small hole portions each have a diameter substantially equal to the diameter of the cord, and the opposite engaging walls have a width smaller than the diameter of the cord.

2. The cord connector of claim 1, wherein the housing is integrally formed as a single member.

3. The cord connector of claim 1, wherein the housing comprises a first half shell having a positioning notch arranged at an inner side thereof, and a second half shell having a positioning wall arranged at an inner side thereof and inserted into the positioning notch; the cord hole is defined between tops of the first and second half shells.

4. The cord connector of claim 3, wherein the positioning wall of the second half shell comprises an urging end engaged in the positioning notch of the first half shell and provided with a cut.

5. The cord connector of claim 4, wherein the first half shell comprises a retaining wall neighbored to the positioning notch and urged against the urging end of the positioning wall of the second half shell.

6. The cord connector of claim 3, wherein the first half shell has a bottom with a first coupling portion and the second half shell has a bottom with a second coupling portion detachably coupled with the first coupling portion.

7. The cord connector of claim 6, wherein the first coupling portion is a concavity and the second coupling portion is a convexity engaged in the concavity.

8. The cord connector of claim 7, wherein the second half shell comprises a coupling wall extending outwardly from the bottom of the second half shell and abutted with the bottom of the first half shell and provided with the second coupling portion.

* * * * *